US006444312B1

(12) United States Patent
Dugan

(10) Patent No.: US 6,444,312 B1
(45) Date of Patent: Sep. 3, 2002

(54) SPLITTABLE MULTICOMPONENT FIBERS CONTAINING A POLYACRYLONITRILE POLYMER COMPONENT

(75) Inventor: Jeffrey S. Dugan, Johnson City, TN (US)

(73) Assignee: Fiber Innovation Technology, Inc., Johnston City, TN (US)

( * ) Notice: Subject to any disclaimer, the term of this patent is extended or adjusted under 35 U.S.C. 154(b) by 0 days.

(21) Appl. No.: 09/456,861

(22) Filed: Dec. 8, 1999

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS

| | | | | |
|---|---|---|---|---|
| 3,485,706 | A | | 12/1969 | Evans |
| 3,547,763 | A | | 12/1970 | Hoffman, Jr. |
| 3,972,759 | A | | 8/1976 | Buntin |
| 3,978,185 | A | | 8/1976 | Buntin et al. |
| 4,622,259 | A | | 11/1986 | McAmish et al. |
| 4,626,263 | A | | 12/1986 | Inoue et al. |
| 4,789,592 | A | | 12/1988 | Taniguchi et al. |
| 4,798,850 | A | | 1/1989 | Brown |
| 4,874,399 | A | | 10/1989 | Reed et al. |
| 5,057,368 | A | | 10/1991 | Largman et al. |
| 5,069,970 | A | | 12/1991 | Largman et al. |
| 5,108,820 | A | | 4/1992 | Kaneko et al. |
| 5,162,074 | A | | 11/1992 | Hills |
| 5,256,176 | A | | 10/1993 | Matsuura et al. |
| 5,277,976 | A | | 1/1994 | Hogle et al. |
| 5,336,552 | A | | 8/1994 | Strack et al. |
| 5,368,734 | A | | 11/1994 | Wnenchak |
| 5,382,400 | A | | 1/1995 | Pike et al. |
| 5,558,809 | A | | 9/1996 | Groh et al. |
| 5,597,645 | A | | 1/1997 | Pike et al. |
| 5,602,222 | A | | 2/1997 | Smierciak et al. |
| 5,618,901 | A | | 4/1997 | Smierciak et al. |
| 5,726,107 | A | | 3/1998 | Dahringer et al. |
| 5,733,625 | A | * | 3/1998 | Tsuchiya et al. ..... 428/113 |
| 5,759,926 | A | | 6/1998 | Pike et al. |
| 5,783,503 | A | | 7/1998 | Gillespie et al. |
| 5,792,242 | A | | 8/1998 | Haskett |
| 5,871,845 | A | | 2/1999 | Dahringer et al. |
| 5,888,274 | A | | 3/1999 | Frederick |
| 5,898,981 | A | | 5/1999 | Legare |
| 5,900,305 | A | | 5/1999 | Chapman |
| 5,902,530 | A | | 5/1999 | Jorkasky et al. |
| 5,908,598 | A | | 6/1999 | Rousseau et al. |
| 5,919,847 | A | | 7/1999 | Rousseau et al. |
| 5,948,528 | A | * | 9/1999 | Helm, Jr. et al. ..... 428/373 |

OTHER PUBLICATIONS

P.A. Smith, G.C. East Department Of Textile Industries, The University, Leeds (Great Britain) and R.C. Brown and D. Wake, Health and Safety Executive, Broad Lane, Sheffield (Great Britain), "Generation Of Triboelectric Charge In Textile Fibre Mixtures, and Their Use As Air Filters", *Journal of Electrostatics,* 1988, pp. 81–98 vol. 21, Elsevier Science Publishers B.V.

Lawrence E. Ball, and Richard J. Jorkasky II, "BP Chemicals Introduces Amlon, a New Acrylic Fiber Technology", *Chemical Engineering,* Apr. 1998, pp. 42, 44, 47.

Eric Bobinsky, "Spinning yarns with melting molecules", *Review,* Apr.–Jun. 1998, pp. 29–31.

* cited by examiner

*Primary Examiner*—Newton Edwards
(74) *Attorney, Agent, or Firm*—Alston & Bird LLP

(57) ABSTRACT

Disclosed are melt processable multicomponent fibers in which at least one component includes a polyacrylonitrile polymer and at least one component includes a polyolefin polymer. The melt processable multicomponent fibers of the present invention may be mechanically split into microfilaments formed entirely of the respective components. The fibers of the present invention may be used in a variety of textile applications, including in electret filter media.

38 Claims, 4 Drawing Sheets

SPLITTABLE MULTICOMPONENT FIBERS CONTAINING A POLYACRYLONITRILE POLYMER COMPONENT

FIELD OF THE INVENTION

The present invention is related to fine denier polyacrylonitrile fibers, and in particular, fine denier polyacrylonitrile fibers obtained by splitting multicomponent fibers and to fabrics made from such fine fibers.

BACKGROUND OF THE INVENTION

Filtration processes are used to separate compounds of one phase from a fluid stream of another phase by passing the fluid stream through filtration media, or septum, which traps the entrained or suspended matter. The fluid stream may be either a liquid stream containing a solid particulate or a gas stream containing a liquid or solid aerosol.

In recent years, particular emphasis has been placed on air filtration, in specific the filtration of respirable dust from air streams. It is now widely recognized that inhaled particulates, particularly particles in the sub-10 micron range, have adverse health effects. In 1970, the U.S. Environmental Protection Agency (EPA) set forth a National Ambient Quality standard for particulate matter directed at the reduction of respirable particles contained in emissions. Filters are widely used to control the particulate matter released in emissions because filters are reliable, efficient, and economical. For example, high efficiency particulate air (HEPA) filters and ultra efficiency particulate air (ULPA) filters have been developed which specifically target the removal of fine respirable particulates.

Fabrics are widely used as filtration media. Conventional filters remove particulates by physically obstructing the flow of particles of a given size or larger; i.e., by mechanical action. A fundamental dilemma in the use of fabrics in small particulate filtration is that conventional textile fibers, having fiber diameters of 20 microns or more, are relatively coarse in comparison to the particulates to be removed. These relatively thick fibers produce filter media having large interfiber pores. Such open, porous structures do not provide suitable interstitial configurations for efficiently trapping fine contaminant particles.

Extremely fine fibers are known to be beneficial in the filtration of extremely small particulates. These fine denier fibers may be used to produce fabrics having smaller pore sizes, thus allowing smaller particulates to be filtered from a fluid stream. In addition, fine denier fibers can provide a greater surface area per unit weight of fiber, also considered beneficial in filtration applications.

Meltblown technology is one avenue by which to produce such fine denier filaments. Fine denier meltblown webs have been widely employed as filter media because the densely packed fibers of these webs are conducive for providing high filter efficiency. However, meltblown webs typically do not have good physical strength, primarily because less orientation is imparted to the polymer during processing and lower molecular weight resins are employed. Thus, in general, meltblown filter media are laminated to at least one separate, self-supporting layer, which adds cost and complexity to the manufacturing process. Although the physical integrity of the meltblown web can be improved by increasing the thickness of the web, this in turn increases the pressure drop required to force air through the filter media. In addition to producing fine denier filaments, meltblown technology also typically yields shorter fibers than other fiber formation techniques. This is problematic because these short fibers cannot easily be entangled using conventional nonwoven web formation processes, such as hydroentangling and needlepunching.

Conventional melt extrusion processes can provide higher strength fibers than meltblown fibers. However, it is difficult to produce fine denier fibers, in particular fibers of 2 denier or less, using conventional melt extrusion processes. Therefore, while filter media produced from nonwoven webs of conventional textile fibers, such as spunbond and staple fiber webs, have been used in filtration applications such as stove hood filters, there is room for improvement in their use as filter media for fine particulates.

One avenue by which to produce fine denier fibers using conventional melt extrusion is to split multicomponent continuous filament or staple fiber into fine denier filaments, or microfilaments, in which each fine denier filament has only one polymer component. Multicomponent fibers, also referred to as composite fibers, may be split into fine fibers comprised of the respective components, if the composite fiber is formed from polymers which are incompatible in some respect. The single composite filament thus becomes a bundle of individual component microfilaments following splitting. See, for example, U.S. Pat. Nos. 5,783,503 and 5,759,926, reporting splittable multicomponent fibers containing polypropylene, such as splittable polyester/polypropylene and nylon/polypropylene fibers.

A number of processes are known for separating multicomponent fibers into fine denier filaments. The particular process employed depends upon the specific combination of components comprising the fiber, as well as their configuration. One common process by which to divide a multicomponent fiber involves mechanically working the fiber, by means such as drawing on godet rolls, needle punching or hydroentangling. The production of mechanically splittable multicomponent fibers presents challenges not encountered in the production of other types of composite fibers. In particular, when mechanical action is used to separate multicomponent fibers, the fiber components must be selected carefully to provide an adequate balance between adhesive and dissociative properties. In particular, poor bonding is known to facilitate the separation process. Conversely, the components should remain bonded during at least a portion of the downstream processing incurred in fabric formation. To add to this difficulty, many conventional textile processes, such as carding, impart significant stress to the fiber, thus promoting premature splitting. Premature splitting is highly undesirable because conventional textile equipment is frequently not designed to process extremely fine filaments, and quickly becomes fouled by them. In addition to their adhesive properties, the melt rheologies of the polymers comprising the multicomponent fiber also strongly influence the splitting process. For example, the melt rheologies of the two components must be such that one component does not totally encapsulate the other during melt spinning, thus precluding later splitting.

As an alternative to the use of fine denier fibers, the efficiency of filters may also be increased by utilizing electrets, generally defined as electrically non-conductive materials capable of storing an applied charge for a relatively long period of time. In particular, electret filters are known to have a higher filtration efficiency than a comparable neutral filter, with no greater resistance to air flow. This increase in efficiency is due to the fact that substantially all industrial processes produce both positively and negatively charged particulate matter. For example, energy intensive operations, such as grinding, are known to produce particles with extremely high levels of charge. It is generally accepted that these charged particles are electrostatically attracted to oppositely charged surfaces within an electret filter. Further, in contrast to traditional mechanical filtration, which occurs primarily at the surface of the filtration media, electret filters contain charged fiber surfaces throughout the filter thickness, thus providing a greater total surface area for filtration.

Many conventional polymers, such as those used in textile fibers, develop and retain charges on their surface for an extended period of time, thus forming electrets. A wide variety of polymers may be used to produce electret fibers, including polypropylene, polyethylene, nylon, acrylic, modacrylic and polytetraflouroethylene. In particular, nonwoven fabrics formed from polypropylene fiber are known for use in electret filters. Such filters are disclosed in U.S. Pat. Nos. 5,597,645 and 5,792,242. See also U.S. Pat. No. 4,874,399, reporting the additional benefits of a polypropylene polymer blend in electret filter applications. Polypropylene is attractive for use in filtration because, in addition to its electret properties, it is economical, insensitive to moisture, has adequate tensile properties, and superior chemical resistance. However, although electret filters comprised entirely of polypropylene are known, the charge developed in such filters is limited because each individual fiber carries both a positive and a negative charge. Single fiber electrets carry this dual charge on opposite sides of the fiber diameter. This is problematic because the strength of the overall charge which develops on a filament is dependent on fiber diameter, namely, smaller diameter fibers have lower maximum charge strength than larger diameter fibers. Several factors are involved in this phenomenon. Namely, opposite charges on a contiguous surface have a natural tendency to migrate towards each other over time, ultimately resulting in charge neutralization. Further, the driving force required for charge neutralization is inversely proportional to the distance across which the charges must bleed during neutralization and directly proportional to the strength of the opposite charges. Therefore, it is generally difficult to develop and/or retain significant amounts of charge in fine diameter single fiber electrets.

Mixed fiber electrets can be used to avoid charge neutralization and to allow higher charges to develop on the fiber surfaces. In particular, electret filters containing a blend of fibers that are separated on the triboelectric series are known to develop and retain a greater charge. The triboelectric series is a scale that ranks a material's ability to donate or accept electrons. Such a series is provided for textile yarns by Smith and East in "Generation of Triboelectric Charge in Textile Fibre Mixtures, and Their Use as Air Filters," Journal of Electrostatics, 21 (1988), p. 81–98, hereby incorporated by reference. Depending on the triboelectric properties of two surfaces, electrons can migrate from the surface of one of the materials to the surface of the other during contact. When the two surfaces are subsequently separated, one surface loses electrons, becoming more positive, while the other surface gains electrons, becoming more negative. The amount of electrons transferred depends both on the triboelectric properties of the two materials (which also correlates with differences between their dielectric constants) and the amount of surface area which is in contact. The ability to charge electret materials via such contact or friction is referred to as triboelectification.

Mixed fiber electrets containing a blend of fibers at opposing ends of the triboelectric series is disclosed in various patents, including U.S. Pat. Nos. 5,888,274; 5,368,734; and 4,798,850. For example, U.S. Pat. No. 5,368,734 is directed to electret filters formed from a blend of polytetraflouroethylene (PTFE) fibers and nylon fibers. However, the use of PTFE fibers is cost prohibitive.

Smith and East disclose mixed fiber electret fabrics containing a blend of polypropylene and acrylic fibers. See P. A. Smith and G. C. East, "Generation Of Triboelectric Charge In Textile Fibre Mixtures, And Their Use As Air Filters, 21 Journal of Electrostatics," 81–98 (1988). The use of acrylic fibers, however, is problematic in the production of filtration media for filtering fine particulates. There are process limitations constraining the formation of multicomponent fibers that include an acrylic polymeric component. In this regard, acrylic fibers are typically produced using solution spinning, and it is not currently commercially possible to form a multicomponent fiber having both solution spun components and melt processable components. Thus, filters including both acrylic fibers and other fibers must be prepared by separately producing the respective monocomponent fibers and then blending the fibers when making the filler. However, while small diameter acrylic fibers can be made, as discussed above, such fibers typically do not have adequate tensile strength.

SUMMARY OF THE INVENTION

The present invention combines the benefits derived from both fine denier fibers and mixed fiber systems. The present invention provides splittable multicomponent fibers and fiber bundles that include a plurality of fine denier filaments having many varied applications in the textile and industrial sector. The multicomponent fibers and fine denier filaments can exhibit many advantageous properties, including the ability to develop and retain a significant level of charge on their surfaces for an extended period of time, and the like. The present invention further provides fabrics and filters, including electret filters, formed of the multicomponent fibers and fiber bundles, as well as processes by which to produce fine denier filaments and articles therefrom.

In particular, the invention provides splittable fibers having at least one component comprising a melt processable polyacrylonitrile polymer and at least one component comprising a polyolefin polymer, preferably polypropylene. The polymer components are dissociable by mechanical means to form a bundle of fine denier fibers. The multicomponent fibers prior to dissociation can have a variety of configurations, including pie/wedge fibers, segmented round fibers, segmented oval fibers, segmented rectangular fibers, segmented ribbon fibers, and segmented multilobal fibers. Further, the mechanically splittable multicomponent fibers can be in the form of continuous filaments, staple fibers, or meltblown fibers. The splittable fibers may be dissociated by a variety of mechanical actions, such as hydroentangling, carding, crimping, drawing, and the like.

The instant invention also provides a fiber bundle that includes a plurality of dissociated microfibers of different polymer compositions. Specifically the fiber bundle includes a plurality of polyacrylonitrile microfilaments and a plurality of polyolefin microfilaments, advantageously polypropylene microfilaments. In general, the microfilaments of the present invention range in size from 0.05 to 1.5 denier, and have a tenacity ranging from about 1.5 to about 4 grams/denier (gpd).

The multicomponent fibers of the present invention can be formed into a variety of textile structures, including nonwoven webs, either prior to or after fiber dissociation. Fabrics made using the fine denier fibers of the present invention are economical to produce and further provide superior characteristics, particularly when used as filter media. The fine denier fibers increase filter efficiency. In addition, a blend of fibers that differ significantly in their triboelectric characteristics, such as the blend of polyacrylonitrile fibers and polyolefin fibers, is beneficial in electret filters. Similarly, a blend of fine denier polyamide and polyolefin filaments is also beneficial in electret applications.

Fine denier fibers possessing superior tensile properties comprising polyacrylonitrile were not heretofore available. Surprisingly, the inventors have found that a multicomponent fiber which is both readily splittable, yet able to survive conventional textile processing intact, can be formed from polyacrylonitrile and a polyolefin, such as polypropylene.

Another aspect of the invention teaches fabrics formed from mechanically divisible multicomponent fibers comprised of at least one polyacrylonitrile polymer component and at least one polyolefin component, as well as the methods by which to produce such fabrics. In this aspect of the invention, the multicomponent fibers can be divided into microfilaments either prior to, during, or following fabric formation. Fabrics of the present invention may generally be formed by weaving, knitting, or nonwoven processes. Advantageously the fabric is a dry-laid nonwoven fabric formed from the multicomponent fibers of the present invention. Another advantageous fabric is a dry-laid nonwoven fabric bonded by hydroentangling.

Products comprising the fabric of the present invention provide further advantageous embodiments. Particularly preferred products include electret filtration media. In one aspect of this preferred embodiment of the invention, a nonwoven fabric comprised of the microfilaments of the present invention is needlepunched to charge the fabric structure, thus providing a superior electret filter medium.

Further understanding of the processes and systems of the invention will be understood with reference to the brief description of the drawings and detailed description which follows herein.

DETAILED DESCRIPTION OF THE INVENTION

The present invention will be described more fully hereinafter in connection with illustrative embodiments of the invention which are given so that the present disclosure will be thorough and complete and will fully convey the scope of the invention to those skilled in the art. However, it is to be understood that this invention may be embodied in many different forms and should not be construed as being limited to the specific embodiments described and illustrated herein. Although specific terms are used in the following description, these terms are merely for purposes of illustration and are not intended to define or limit the scope of the invention. As an additional note, like numbers refer to like elements throughout.

Referring now to FIG. 1, cross sectional views of exemplary multicomponent fibers of the present invention are provided. The multicomponent fibers of the invention, designated generally as 4, include at least two structured polymeric components, a first component 6, comprising a melt processable polyacrylonitrile polymer, and a second component 8, comprising a polyolefin polymer.

In general, multicomponent fibers are formed of two or more polymeric materials which have been extruded together to provide continuous contiguous polymer segments which extend down the length of the fiber. For purposes of illustration only, the present invention will generally be described in terms of a bicomponent fiber. However, it should be understood that the scope of the present invention is meant to include fibers with two or more components. In addition, the term "fiber" as used herein means both fibers of finite length, such as conventional staple fiber, as well as substantially continuous structures, such as filaments, unless otherwise indicated.

Figure 1A:
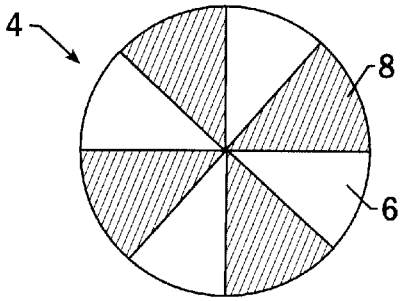
FIGS. 1A–1E are cross sectional views of exemplary embodiments of multicomponent fibers in accordance with the present invention.
Figure 1B:
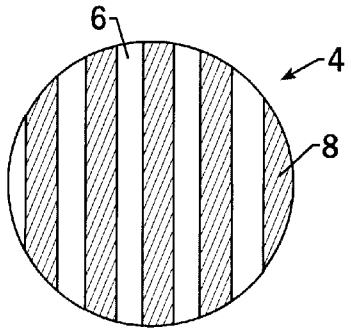
Figure 1C:
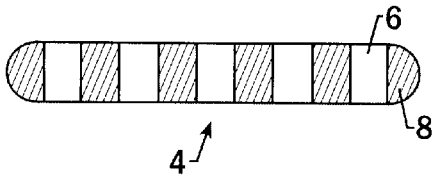
Figure 1D:
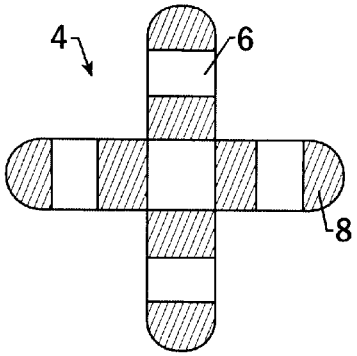
Figure 1E:
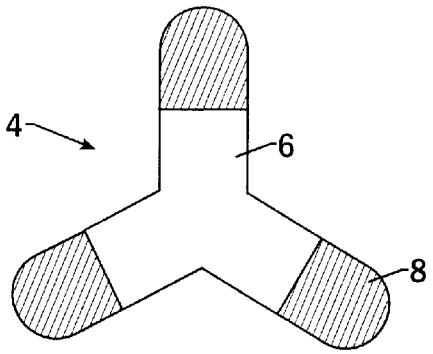

As illustrated in FIGS. 1A–1E, a wide variety of fiber configurations that allow the polymer components to be free to dissociate are acceptable. Typically, the fiber components are arranged so as to form distinct unocclusive cross-sectional segments along the length of the fiber so that none of the components is physically impeded from being separated. One advantageous embodiment of such a configuration is the pie/wedge arrangement, shown in FIG. 1A. The pie/wedge fibers can be hollow or non-hollow fibers. In particular, FIG. 1A provides a bicomponent filament having eight alternating segments of triangular shaped wedges of a polyacrylonitrile polymer component 6 and a polyolefin component 8. It should be recognized that more than eight or less than eight segments can be produced in filaments made in accordance with the invention. Other fiber configurations as known in the art may be used, such as but not limited to, the segmented round configuration shown in FIG. 1B, commonly referred to as a conjugate fiber. Reference is made to U.S. Pat. No. 5,108,820 to Kaneko et al., U.S. Pat. No. 5,336,552 to Strack et al., and U.S. Pat. No. 5,382,400 to Pike et al. for a further discussion of multicomponent fiber constructions.

Further, the multicomponent fibers need not be conventional round fibers. Other useful shapes include the segmented ribbon configuration shown in FIG. 1C, the segmented cross configuration in FIG. 1D, and the multilobal configuration of FIG. 1E. Such unconventional shapes are further described in U.S. Pat. No. 5,277,976 to Hogle et al., and U.S. Pat. Nos. 5,057,368 and 5,069,970 to Largman et al.

Both the shape of the fiber and the configuration of the components therein will depend upon the equipment used in the preparation of the fiber, the process conditions, and the melt viscosities of the two components. A wide variety of fiber configurations are possible. As will be appreciated by the skilled artisan, the fiber configuration is chosen such that one component does not encapsulate, or only partially encapsulates, other components. Stated differently, at least a portion of the polymer components forms an exposed surface of the multicomponent fiber.

Further, to provide dissociable properties to the composite fiber, the polymer components are chosen so as to be mutually incompatible. In particular, the polymer components do not substantially mix together or enter into chemical reactions with each other. Specifically, when spun together to form a composite fiber, the polymer components exhibit a distinct phase boundary between them so that substantially no blend polymers are formed, preventing dissociation. In addition, a balance of adhesion/incompatibility between the components of the composite fiber is considered highly beneficial. The components advantageously adhere sufficiently to each other to allow the unsplit multicomponent fiber to be subjected to conventional textile processing such as winding, twisting, weaving, knitting or carding without any appreciable separation of the components until desired. Conversely, the polymers should be sufficiently incompatible so that adhesion between the components is sufficiently weak, thereby allowing ready separation upon the application of sufficient external force.

In general, at least one component of the multicomponent fibers of the invention includes a melt processable polyacrylonitrile polymer. As used here, the term "polyacrylonitrile polymer" includes polymers comprising at least about 85% by weight acrylonitrile units (generally known in the art as acrylic or polyacrylonitrile polymers). The term polyacrylonitrile polymer as used herein also includes polymers which have less that 85% by weight acrylonitrile units. Such polymers include modacrylic polymers, generally defined as polymers comprising 35–85% by weight acrylonitrile units and typically copolymerized with vinyl chloride or vinylidene chloride. Preferably, the polyacrylonitrile polymer has at least 85% by weight polyacrylonitrile units.

In contrast to conventional solution spun polyacrylonitrile fibers, the multicomponent fibers of the invention include a melt processable polyacrylonitrile polymer. Exemplary melt processable polyacrylonitriles are described in U.S. Pat. Nos. 5,602,222 and 5,618,901 the entire disclosure of each of which is hereby incorporated by reference. See also U.S. Pat. No. 5,902,530, the entire disclosure of which is also incorporated herein by reference. Such polymers are commercially available, for example, from BP Chemicals as the "Amlon™" acrylic polymers, "Barex®" acrylic polymers, and the like. See *International Fiber Journal,* p. 42, April 1998, hereby incorporated by reference in its entirety.

Melt processable polyacrylonitrile is particularly attractive for use in the present invention because it is a thermoplastic resin having adequate heat resistance, with a melting point of approximately 185° C. Melt processable polyacrylonitrile fibers exhibit superior weatherability, have adequate strength and resilience, and are insensitive to water. In addition, the use of polyacrylonitrile fibers in filtration applications is especially advantageous because polyacrylonitrile possesses superior chemical resistance. The use of polyacrylonitrile fibers in electret filters is further desirable because these fibers have the ability to develop and hold a charge on their surface for extended periods of time, e.g. for up to about 18 months.

In addition to containing acrylonitrile monomer, melt processable polyacrylonitrile polymers typically include olefinically unsaturated monomer. The acrylonitrile olefinically unsaturated polymer is preferably made up of about 50 weight % to about 95 weight %, preferably about 75 weight % to about 93 weight %, and most preferably about 85 weight % to about 92 weight %, of polymerized acrylonitrile monomer, and at least one of about 5 weight % to about 50 weight %, preferably about 7 weight % to about 25 weight %, and most preferably about 8 weight % to about 15 weight %, of polymerized olefinically unsaturated monomer.

The olefinically unsaturated monomer can include one or more of an olefinically unsaturated monomer with a C=C double bond polymerizable with an acrylonitrile monomer. The olefinically unsaturated monomer can be a single polymerizable monomer resulting in a co-polymer, or a combination of polymerizable monomers resulting in a multipolymer. The choice of olefinically unsaturated monomer or a combination of monomers can depend upon the properties desired to impart to the resulting fiber and its end use. The olefinically unsaturated monomer generally includes, but is not limited to, acrylates such as methyl acrylates and ethyl acrylates; methacrylates, such as methyl methacrylate; acrylamides and methacrylamides and each of their N-substituted alkyl and aryl derivatives, such as acrylamide, methacrylamide, N-methacrylimide, N,N-dimethyl acrylamide; maleic acid and its derivatives, such as N-phenylmaleimide; vinylesters, such as vinyl acetate; vinylethers, such as ethyl vinyl ether and butyl vinyl ether; vinylamides, such as vinyl pyrrolidone; vinylketones, such as ethyl vinyl ketone and butyl vinyl ketone; styrenes, such as methylstyrene, stryene and indene; halogen containing monomers, such as vinyl chloride, vinyl bromide, and vinylidene chloride; ionic monomers, such as sodium vinylsulfonate, sodium styrenesulfonate, and sodium methyl sulfonate; acid containing monomers such as itaconic acid, styrene sulfonic acid and vinyl sulfonic acid; base-containing monomers, such as vinyl pyridine, 2-aminoethyl-N-acrylamide, 3-aminopropyl-N-acrylamide, 2-aminoethylacrylate, 2-aminoethylmethacrylate; and olefins, such as propylene, ethylene, isobutylene. Other monomers, such as vinyl acetate, acrylic esters, and vinyl pyrrolidone, may also be included in conventional polyacrylonitrile in small amounts, to allow the resulting polyacrylonitrile fiber to be dyed with conventional textile dyes. Additional properties may also be imparted to melt processable polymers containing significant amounts of acrylonitrile by choosing appropriate co-monomers or blends thereof. For example, the inclusion of styrene in the polymer results in improved heat distortion; isobutylene improves the flexibility; halogen containing monomers increase the flame resistance of the polymer. Still further, the acrylonitrile polymer can include methacrylonitrile monomer. The use of such co-monomers is discussed in more detail in U.S. Pat. Nos. 5,602,222 and 5,618,901.

In addition, in the embodiment of the present invention directed to electret filters, other melt processable polymers capable of forming a splittable fiber in combination with a polyolefin, particularly those polymers that become significantly electropositive upon tribocharging, may be useful as well. Polyamides split readily from polyolefins and carry and retain such a positive charge, particularly nylon 6 and nylon 66, and these polymers find utility in the present invention, as well.

At least one other component of the fibers of the invention includes a polyolefin polymer. Suitable polyolefins include without limitation polymers such as polyethylene (low density polyethylene, high density polyethylene, linear low density polyethylene), polypropylene (isotactic polypropylene, syndiotactic polypropylene, and blends of isotactic polypropylene and atactic polypropylene), poly-1-butene, poly-1-pentene, poly-1-hexene, poly-1-octene, polybutadiene, poly-1,7,-octadiene, and poly-1,4,-hexadiene, and the like, as well as copolymers, terpolymers and mixtures of thereof. Polyethylene, polypropylene, and poly-1-butene are considered to be particularly advantageous. Polypropylene (PP) is particularly preferred. Polypropylene is commercially available from many manufacturers, including Fina Oil and Chemical Co. Blends of polypropylene with small amounts of poly(4-methyl-1-pentene) are also known to be beneficial in those advantageous embodiments directed to electret filtration, as disclosed in U.S. Pat. No. 4,874,399.

Each of the polymeric components can optionally include other components not adversely effecting the desired properties thereof. Exemplary materials which could be used as additional components would include, without limitation, pigments, antioxidants, stabilizers, certain surfactants, waxes, flow promoters, solid solvents, particulates, and other materials added to enhance processability of the first and the second components. In those embodiments directed to electret filtration, additives, in particular dyes and other charge control agents, are also known to tailor the electret properties of polymers, as described in U.S. Pat. Nos. 5,888,274; 5,726,107; 5,871,845; and 5,558,809. These and other additives can be used in conventional amounts.

In addition to other additives, it is common practice in the manufacture of fibers to apply a "spin finish" comprised of a mixture of lubricants and antistatic agents. In those embodiments of the present invention directed to electret filter media, such spin finish should either be avoided or the spin finish removed prior to imparting charge to the filter. For fibers to which such spin finish has been applied, any of the conventional processes of textile scouring may be employed for its removal.

The weight ratio of the polyacrylonitrile component and the polyolefin component can vary. Preferably the weight ratio is in the range of about 10:90 to 90:10, more preferably from about 20:80 to about 80:20, and most preferably from about 35:65 to about 65:35. In addition, the dissociable multicomponent fibers of the invention can be provided as staple fibers, continuous filaments, or meltblown fibers.

In general, staple, multi-filament, and spunbond multicomponent fibers formed in accordance with the present invention can have a fineness of about 0.5 to about 100 denier. Meltblown multicomponent filaments can have a fineness of about 0.001 to about 10.0 denier. Monofilament multicomponent fibers can have a fineness of about 50 to about 10,000 denier. Denier, defined as grams per 9000 meters of fiber, is a frequently used expression of fiber diameter. A lower denier indicates a finer fiber and a higher denier indicates a thicker or heavier fiber, as is known in the art.

Dissociation of the multicomponent fibers provides a plurality of fine denier filaments or microfilaments, each formed of the different polymer components of the multicomponent fiber. As used herein, the terms "fine denier filaments" and "microfilaments" include sub-denier filaments and ultra-fine filaments. Sub-denier filaments typically have deniers in the range of 1 denier per filament or less. Ultra-fine filaments typically have deniers in the range of from about 0.1 to 0.3 denier per filament. As discussed previously, fine denier filaments of low orientation have previously been obtained from relatively low molecular weight polymers by meltblowing. The present invention provides much stronger fine denier meltspun polyacrylonitrile filaments than previously available. In addition, the invention provides a method by which continuous fine denier polyacrylonitrile filaments can be produced at commercial throughputs from relatively high molecular weight polymers with acceptable manufacturing yields.

Figure 2A:
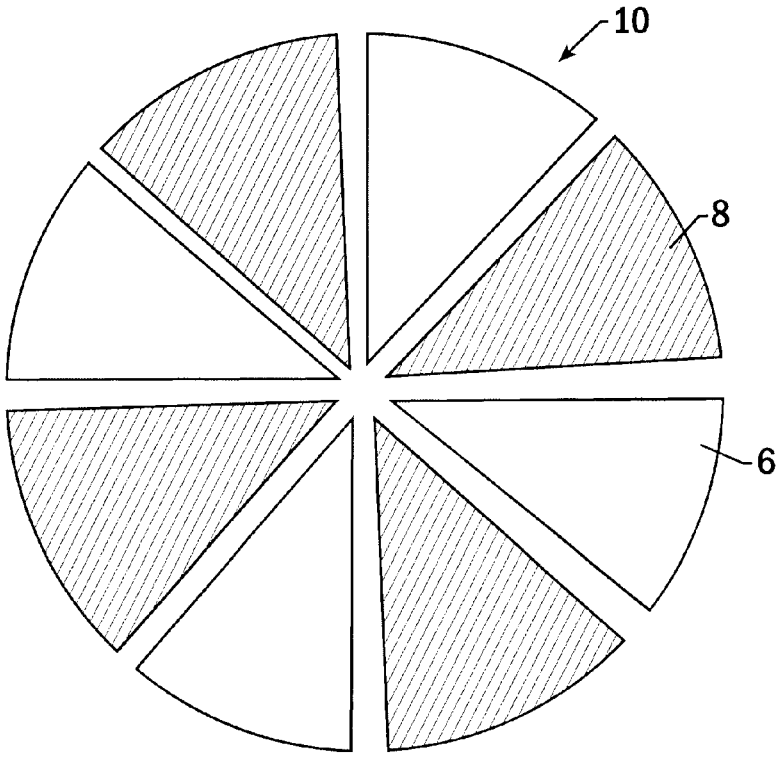
FIGS. 2A and 2B are cross sectional and longitudinal views, respectively, of an exemplary dissociated fiber in accordance with one embodiment of the present invention.
Figure 2B:
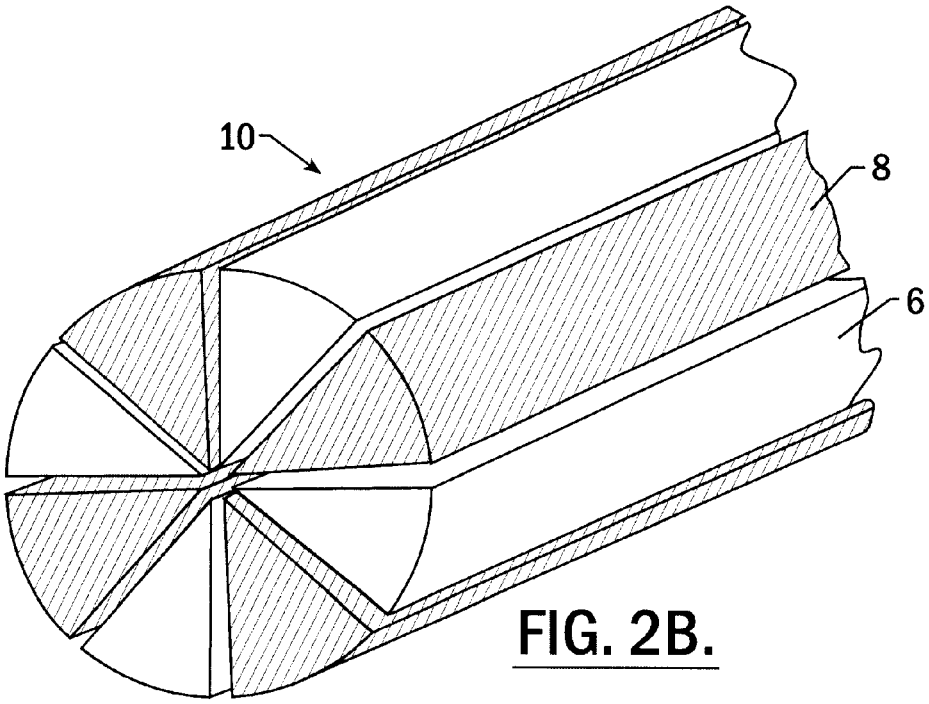

FIG. 2 illustrates an exemplary multicomponent fiber of the present invention that has been separated into a fiber bundle 10 of microfilaments as described above. In the illustrated example, the multicomponent fiber has been divided into four polyacrylonitrile microfilaments 6 and four polyolefin microfilaments 8, thereby providing an eight filament fiber bundle. In a typical example, a multicomponent fiber having 4 to 24, preferably 8 to 20, segments is produced. Generally, the tenacity of the multicomponent fiber ranges from about 1 to about 5.5, advantageously from about 2.0 to about 4.5 grams/denier (gpd). The tenacity of the polyacrylonitrile microfilaments produced in accordance with the present invention can range from about 1.5 to about 6 gpd, and typically from about 2 to about 4. The tenacity for the polypropylene fine denier filaments can range from about 1 to about 5 gpd, typically from about 2 to about 4 gpd. Grams per denier, a unit well known in the art to characterize fiber tensile strength, refers to the force in grams required to break a given filament or fiber bundle divided by that filament or fiber bundle's denier.

The multicomponent fibers of the present invention may be dissociated into separate polyacrylonitrile microfilaments and polypropylene microfilaments by any means that provides sufficient flex or mechanical action to the fiber to fracture and separate the components of the composite fiber. As used herein, the terms "splitting," "dissociating," or "dividing" mean that at least one of the fiber components is separated completely or partially from the original multicomponent fiber. Partial splitting can mean dissociation of some individual segments from the fiber, or dissociation of pairs or groups of segments, which remain together in these pairs or groups, from other individual segments, or pairs or groups of segments from the original fiber. As illustrated in FIG. 2, the fine denier components can remain in proximity to the remaining components as a coherent fiber bundle 10 of fine denier polyacrylonitrile microfilaments 6 and polyolefin microfilaments 8. However, as the skilled artisan will appreciate, in some processing techniques, such as hydroentanglement, or where the fibers are split prior to fabric formation, the fibers originating from a common fiber source may be further removed from one another. Further, the terms "splitting," "dissociating," or "dividing" as used herein also include partial splitting.

Figure 3:
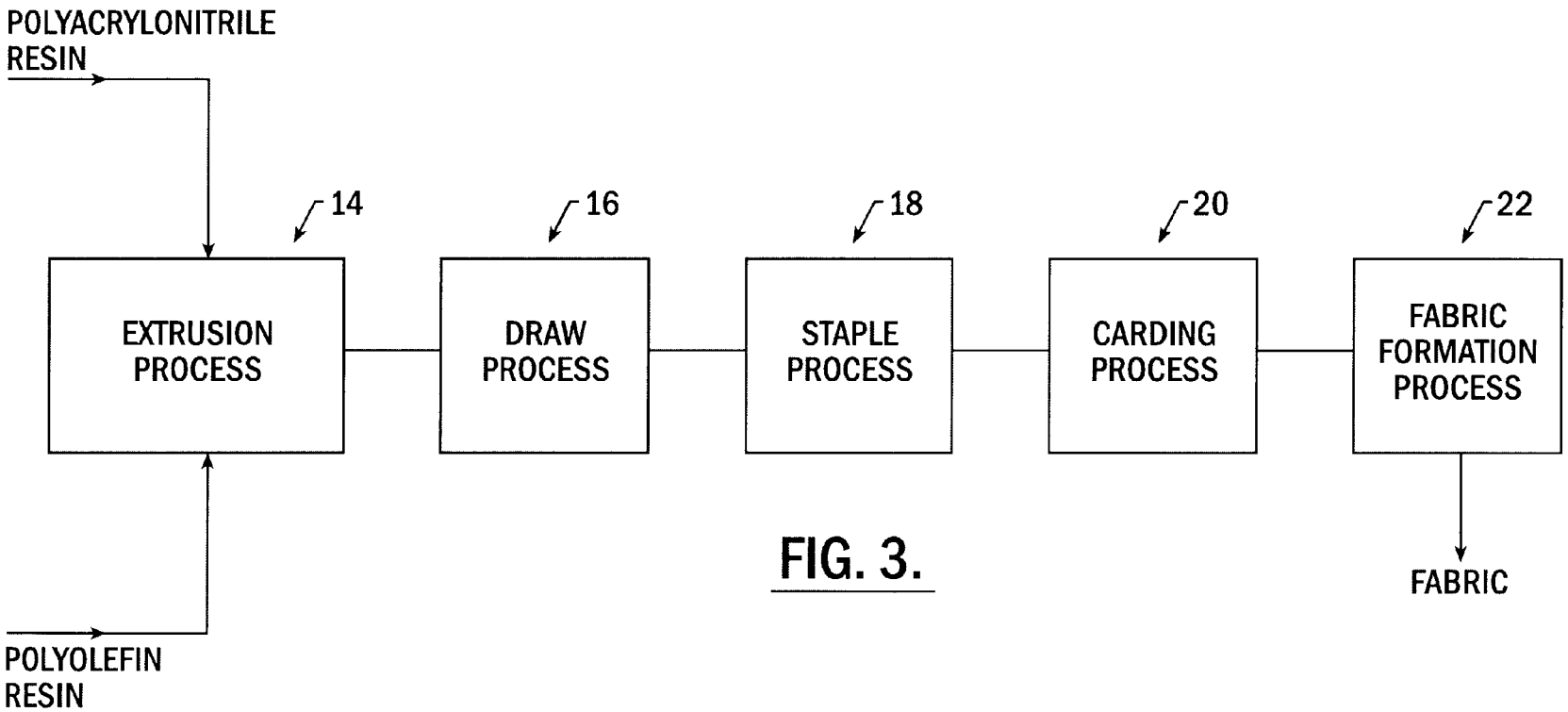
FIG. 3 is a flow diagram illustrating a fabric formation process according to one embodiment of the present invention.

Turning now to FIG. 3, an exemplary process for making a fabric in accordance with one embodiment of the invention is illustrated. Specifically, FIG. 3 illustrates an extrusion process 14, followed by a draw process 16, a staple process 18, a carding process 20, and a fabric formation process 22.

The extrusion process 14 for making multicomponent continuous filament fibers is well known and need not be described here in detail. Generally, to form a multicomponent fiber, at least two polymers are extruded separately and fed into a polymer distribution system wherein the polymers are introduced into a spinneret plate. The polymers follow separate paths to the fiber spinneret and are combined in a spinneret hole. The spinneret is configured so that the extrudant has the desired overall fiber cross section (e.g., round, trilobal, etc.). Such a process is described, for example, in Hills U.S. Pat. No. 5,162,074, the contents of which are incorporated herein by reference in their entirety.

In the present invention, a melt processable polyacrylonitrile polymer stream and a polyolefin polymer stream are fed into the polymer distribution system. The polymers typically are selected to have melting temperatures such that the polymers can be spun at a polymer throughput that enables the spinning of the components through a common capillary at substantially the same temperature without degrading one of the components.

Following extrusion through the die, the resulting thin fluid strands, or filaments, remain in the molten state for some distance before they are solidified by cooling in a surrounding fluid medium, which may be chilled air blown through the strands. Once solidified, the filaments are taken up on a godet or other take-up surface. In a continuous filament process, the strands are taken up on a godet that draws down the thin fluid streams in proportion to the speed of the take-up godet. Continuous filament fiber may further be processed into staple fiber. In processing staple fibers, large numbers, e.g., 10,000 to 1,000,000 strands, of continuous filament are gathered together following extrusion to form a tow for use in further processing, as is known in that art.

Rather than being taken up on a godet, continuous multicomponent fiber may also be melt spun as a direct laid nonwoven web. In a spunbond process, for example, the strands are collected in a jet, such as an air jet or air attenuator, following extrusion through the die and then blown onto a take-up surface such as a roller or a moving belt to form a spunbond web. As an alternative, direct laid composite fiber webs may be prepared by a meltblown process, in which air is ejected at the surface of a spinneret to simultaneously draw down and cool the thin fluid polymer streams which are subsequently deposited on a take-up surface in the path of cooling air to form a fiber web.

Regardless of the type of melt spinning procedure which is used, typically the thin fluid streams are melt drawn in a molten state, i.e. before solidification occurs, to orient the polymer molecules for good tenacity. Typical melt draw down ratios known in the art may be utilized. The skilled artisan will appreciate that specific melt draw down is not required for meltblowing processes.

When a continuous filament or staple process is employed, it may be desirable to subject the strands to a draw process 16. In the draw process the strands are typically heated past their glass transition point and stretched to several times their original length using conventional drawing equipment, such as, for example, sequential godet rolls operating at differential speeds. Draw ratios of 2 to 4 times are typical. Optionally, the drawn strands may be heat set, to reduce any latent shrinkage imparted to the fiber during processing, as is further known in the art.

Following drawing in the solid state, the continuous filaments can be cut into a desirable fiber length in a staple process 18. The length of the staple fibers generally ranges from about 25 to about 50 millimeters, although the fibers can be longer or shorter as desired. See, for example, U.S. Pat. No. 4,789,592 to Taniguchi et al. and U.S. Pat. No. 5,336,552 to Strack et al. Optionally, the fibers may be subjected to a crimping process prior to the formation of staple fibers, as is known in the art. Crimped composite fibers are useful for producing lofty woven and nonwoven fabrics since the microfilaments split from the multicomponent fibers largely retain the crimps of the composite fibers and the crimps increase the bulk or loft of the fabric. Such lofty fine fiber fabric of the present invention exhibits cloth-like textural properties, e.g., softness, drapability and hand, as well as the desirable strength properties of a fabric containing highly oriented fibers.

Figure 4:
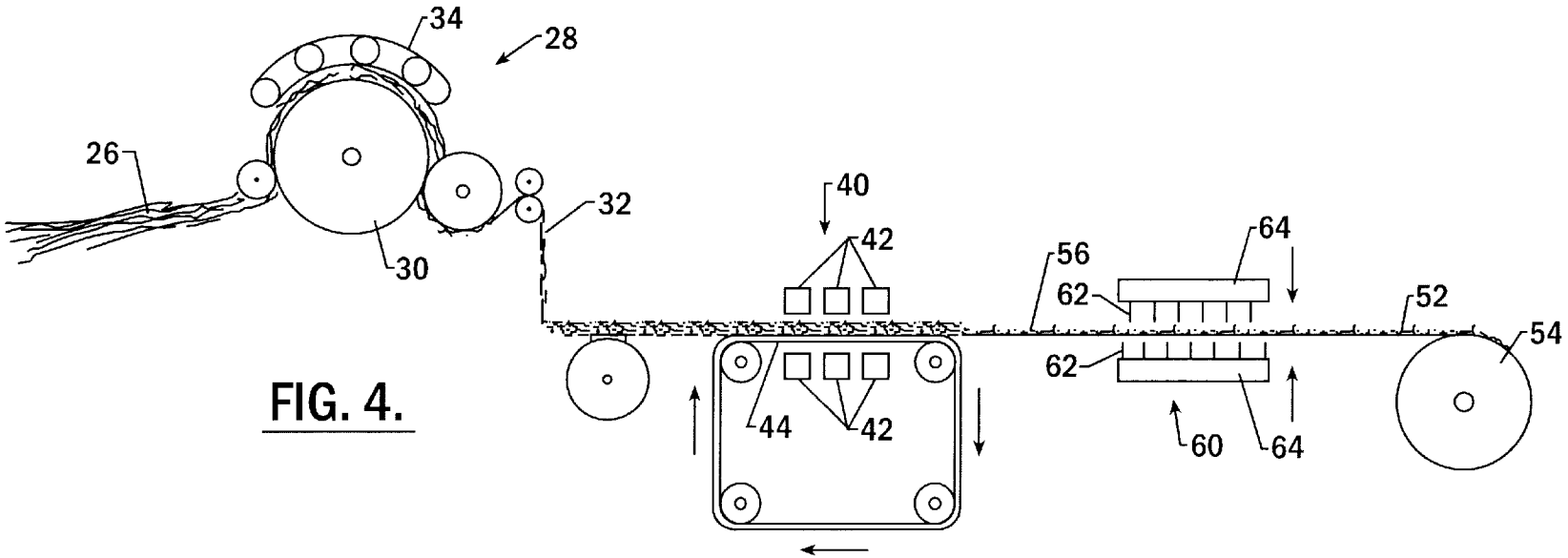
FIG. 4 schematically illustrates several aspects of the process involved in the formation of one advantageous embodiment of electret filter media, particularly the steps of carding, hydroentangling, and needlepunching.

The staple fiber thus formed is then fed into a carding process 20. A more detailed schematic illustration of a carding process is provided in FIG. 4. As shown in FIG. 4, the carding process can include the step of passing staple tow 26 through a carding machine 28 to align the fibers of the staple tow as desired, typically to lay the fibers in roughly parallel rows, although the staple fibers may be oriented differently. The carding machine 28 is comprised of a series of revolving cylinders 34 with surfaces covered in teeth. These teeth pass through the staple tow as it is conveyed through the carding machine on a moving surface, such as a drum 30. The carding process produces a fiber web 32.

Referring back to FIG. 3, in one advantageous embodiment of the invention, carded fiber web 32 is subjected to a fabric formation process to impart cohesion to the fiber web. In one aspect of that embodiment, the fabric formation process includes the step of bonding the fibers of fiber web 32 together to form a coherent unitary nonwoven fabric. The bonding step can be any mechanical bonding process known in the art. Typical methods of mechanical bonding include hydroentanglement and needle punching.

During the carding process, individual fibers are repeatedly brought into intimate contact with each other and subsequently separated. This contact frequently gives rise to unwanted charges on the fiber surface, which interferes with the carding process. Spin finishes comprised of a mixture of lubricants and antistatic agents may be used to eliminate unwanted charges; however, such spin finish must be removed prior to imparting charge to the filter. In the alternative, a sufficient amount of water may be sprayed onto the staple tow 26 prior to the carding process, as is known in the art. Such water is subsequently removed following either the carding or fabric formation processes.

In a preferred embodiment of the present invention, a hydroentangled nonwoven fabric is provided. A schematic of one hydroentangling process suitable for use in the present invention is provided in FIG. 4. As shown in FIG. 4, a fiber web 32 is conveyed longitudinally to a hydroentangling station 40 wherein a plurality of manifolds 42, each including one or more rows of fine orifices, directs high pressure water jets through the fiber web 32 to intimately hydroentangle the staple fibers, thereby providing a cohesive, nonwoven fabric 56.

The hydroentangling station 40 is constructed in a conventional manner as known to the skilled artisan and as described, for example, in U.S. Pat. No. 3,485,706 to Evans, which is hereby incorporated by reference. As known to the skilled artisan, fiber hydroentanglement is accomplished by jetting liquid, typically water, supplied at a pressure of from about 200 psig up to 1800 psig or greater to form fine, essentially columnar, liquid streams. The high pressure liquid streams are directed toward at least one surface of the composite web. In one embodiment of the invention water at ambient temperature and 200 bar is directed towards both surfaces of the web. The composite web is supported on a foraminous support screen 44 which can have a pattern to form a nonwoven structure with a pattern or with apertures or the screen can be designed and arranged to form a hydraulically entangled composite which is not patterned or apertured. The fiber web 32 can be passed through the hydraulic entangling station 40 a number of times for hydraulic entanglement on one or both sides of the composite web or to provide any desired degree of hydroentanglement.

Optionally, the nonwoven webs and fabrics of the present invention may be thermally bonded. In thermal bonding, heat and/or pressure are applied to the fiber web or nonwoven fabric to increase its strength. Two common methods of thermal bonding are air heating, used to produce low-density fabrics, and calendering, which produces strong, low-loft fabrics. Hot melt adhesive fibers may optionally be included in the web of the present invention to provide further cohesion to the web at lower thermal bonding temperatures. Such methods are well known in the art.

In addition, rather than producing a dry-laid nonwoven fabric, an aspect of which was previously described, a nonwoven may be formed in accordance with the instant invention by direct-laid means. In one embodiment of direct laid fabric, continuous filament is spun directly into nonwoven webs by a spunbonding process. In an alternative embodiment of direct laid fabric, multicomponent fibers of the invention are incorporated into a meltblown fabric. The techniques of spunbonding and meltblowing are known in the art and are discussed in various patents, e.g., Buntin et al., U.S. Pat. No. 3,987,185; Buntin, U.S. Pat. No. 3,972,759; and McAmish et al., U.S. Pat. No. 4,622,259. The fiber of the present invention may also be formed into a wet-laid nonwoven fabric, via any suitable technique known in that art.

While particularly useful in the production of nonwoven fabrics, the fibers of the invention can also be used to make other textile structures, such as but not limited to woven and knit fabrics. Yarns prepared for use in forming such woven and knit fabrics are similarly included within the scope of the present invention. Such yarns may be prepared from continuous filaments or spun yarns comprising staple fibers of the present invention by methods known in the art, such as twisting or air entanglement.

In one advantageous embodiment of the invention, the fabric formation process is used to dissociate the multicomponent fiber into microfilaments. Stated differently, forces applied to the multicomponent fibers of the invention during fabric formation in effect split or dissociate the polymer components to form microfilaments. The resultant fabric thus formed is comprised, for example, of a plurality of microfilaments 6 and 8 shown in FIG. 2, and described previously. In a particularly advantageous aspect of the invention, the hydroentangling process used to form the nonwoven fabric dissociates the composite fiber. In other advantageous embodiments, needlepunching is used to simultaneously form the fabric and split the multicomponent fibers. In the alternative, the carding, drawing, or crimping processes previously described may be used to split the multicomponent fiber. Optionally, the composite fiber may be divided after the fabric has been formed by application of mechanical forces thereto. In particular, a separate splitting step is required for fabric formed by methods such as thermal bonding, meltblowing, weaving, and knitting. In addition, the multicomponent fiber of the present invention may be separated into microfilaments before or after formation into a yarn.

The fabrics of the present invention provide a combination of desirable properties of conventional fine denier fabrics and highly oriented fiber fabrics. These properties include fabric uniformity, uniform fiber coverage, good barrier properties and high fiber surface area. The fabrics of the present invention also exhibit highly desirable strength properties, desirable hand and softness, and can be produced to have different levels of loft.

Beneficial products can be produced with the fabrics of the present invention, as well. In particular, nonwoven fabrics formed from the multicomponent fibers of the invention are suitable for a wide variety of end uses. In one particularly advantageous embodiment, nonwoven fabric of the instant invention may be used as a filter medium.

In a preferred embodiment, nonwoven fabric of the present invention may be used as an electret filter medium, in particular a triboelectrically charged electret filter medium. In general, a charge can be developed within electret filtration fabrics by means such as subjecting the fabric to a voltage differential or needlepunching the fabric. In one particularly advantageous aspect of this preferred embodiment, needlepunching is used to impart charge to (or tribocharge) a nonwoven fabric. Returning now to FIG. 4, a schematic of one needlepunching process suitable for use in the present invention is provided in FIG. 4. As shown in FIG. 4, a cohesive, nonwoven fabric 56 is conveyed longitudinally through a needle punching station 60. In general, the needle punching station 60 is comprised of a set of parallel needle boards 64, positioned above and below the nonwoven fabric 56. Barbed needles 62 are set in a perpendicular manner in the needle boards 64. During operation, the needle boards 64 move towards and away from each other in a cyclical fashion, forcing the barbed needles 62 to punch into the nonwoven fabric 56 and withdraw. This punching action causes the fibers to move in relation to each other, imparting a triboelectric charge and creating an electret fabric 52. In an alternative embodiment, a single needle board may be employed.

Needle punching is well known in the art. By varying the strokes per minute, the number of needles per needle board, the advance rate of the fabric, the degree of penetration of the needles, and the weight of the fabric, a wide range of charging conditions can be provided. In one advantageous embodiment, the needlepunching process simultaneously splits the multicomponent fibers, forms fabric, and imparts electret charge to the fabric.

In a further alternative embodiment, electret property enhancing additives, such as those described in U.S. Pat. No. 5,908,598 may be employed, and a hydroentangling process, such as provided by the hydoentangling station 40, may be used to both form and charge the electret fabric 52.

In another alternative embodiment, air is used to charge an electret fabric. In this embodiment, an adequate quantity of air at a sufficient velocity is blown through dry fabric comprised of microfilaments. The friction of the air moving across the microfilament surfaces induces a charge within the fabric.

The microfilament fibers of the present invention are particularly beneficial for use in electret filtration media, particularly electret filters charged by triboelectrification. As described above, triboelectrication requires that the surfaces of two dissimilar materials come into contact and subsequently separate. Therefore, high surface area articles are extremely beneficial in triboelectrification, because such articles provide an increased area for contact. The present invention maximizes the surface area available for contact within the filter by charging microfibers, which inherently posses high surface area to volume ratios.

Furthermore, the present invention provides fabrics possessing a superior blend of fibers in comparison to fabrics formed from conventional fibers. This superior blending is particularly important in electret fabrics, especially tribocharged electret fabrics. Previous mixed fiber electret filters blended an accumulation of one type of fibers, in a form such as a roving, with a similar accumulation of a differing type of fiber. In contrast, the present invention provides an inherent blend of individual microfilaments, ensuring blending at a fiber to fiber basis. Therefore, not only does the present invention not require a separate blending step, it also provides an extraordinarily intimate blend of microfibers. This optimal blending ensures uniform electret filtration throughout the thickness of the fabric, by providing more uniform triboelectrification conditions. Further, the electret filters of the present invention produce a lower pressure drop across the filter in comparison to electret filters formed from conventional fibers for a given filtration efficiency. This lower pressure drop stems from the fact that the use of microfilaments allows a much more open fabric to be used for a given filtration efficiency in comparison to fabric formed from conventional fiber.

The present invention will be further illustrated by the following non-limiting example.

EXAMPLE 1

Continuous multifilament melt spun fiber is produced using a bicomponent extrusion system. A sixteen segment pie/wedge bicomponent fiber is produced having eight segments of a polyacrylonitrile (PAN) polymer and eight segments of polypropylene (PP) polymer. The weight ratio of PAN to PP in the bicomponent fibers is 50/50. The PAN employed is commercially available as Amlon Resin from BP-Amoco Chemical Corp. The PP is Marlex HGX-180 from Phillips Sumika.

Following extrusion, the filaments are subsequently drawn three times, thereby yielding a 3 denier multifilament multicomponent fiber. The fiber is then crimped and cut to 1½ inch length staple fiber. This staple fiber is carded to form a web that is subsequently hydroentangled using water jets operating at 200 bar pressure. The water jets simultaneously entangle the fibers to give the web strength and split the fibers substantially into individual PAN and PP microfibers. The nonwoven fabric comprised of PAN and PP microfibers is then subjected to needlepunching, thus producing a charged fabric structure suitable for use as electret filter media.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A mechanically splittable multicomponent fiber having an outer peripheral surface comprising;

at least one polymer component comprising a melt processable polyacrylonitrile polymer; and at least one polymer component comprising a polyolefin, wherein each of said polymer components forms a portion of the outer peripheral surface of said fiber to form distinct unocclusive cross-sectional segments along a length of the fiber so that said components are not physically impeded from being separated from one another, the weight ratio of said polyacrylonitrile component to said polyolefin component ranges from about 80/20 to about 20/80, and the fiber has a pie/wedge configuration.

2. The fiber of claim 1, wherein said melt processable polyacrylonitrile polymer is selected from the group consisting of modacrylic and acrylic polymers.

3. The fiber of claim 2, wherein said melt processable polyacrylonitrile polymer comprises at least about 85% by weight acrylonitrile units.

4. The fiber of claim 1, wherein said polyolefin is selected from the group consisting of polyethylene, polypropylene, poly-1-butene, and copolymers, terpolymers, and mixtures thereof.

5. The fiber of claim 4, wherein said polyolefin is polypropylene.

6. The fiber of claim 1, wherein said melt processable polyacrylonitrile polymer comprises at least about 85% by weight acrylonitrile units and said polyolefin is polypropylene.

7. The fiber of claim 1, wherein said fiber is selected from the group consisting of continuous filaments, staple fibers, and meltblown fibers.

8. The fiber of claim 7, wherein said fiber is a staple fiber.

9. The fiber of claim 1, wherein said multicomponent fiber is capable of being dissociated by hydroentangling or needle punching.

10. A mechanically splittable multicomponent fiber having an outer peripheral surface comprising:

at least one polymer component comprising a melt processable polyacrylonitrile polymer; and at least one polymer component comprising a polyolefin, wherein each of said polymer components forms a portion of the outer peripheral surface of said fiber to form distinct unocclusive cross-sectional segments along a length of the fiber so that said components are not physically impeded from being separated from one another, the weight, ratio of said polyacrylonitrile component to said polyolefin component ranges from about 80/20 to about 20/80, and the fiber is a segmented round fiber having a round cross-sectional configuration and comprises a plurality of polymer segments formed of a melt-processable polyacrylonitrile polymer alternating with a plurality of polymer segments formed of a polyolefin polymer.

11. A mechanically splittable multicomponent fiber having an outer peripheral surface comprising:

at least one polymer component comprising a melt processable polyacrylonitrile polymer; and at least one polymer component comprising a polyolefin, wherein each of said polymer components forms a portion of the outer peripheral surface of said fiber to form distinct unocclusive cross-sectional segments along a length of the fiber so that said components are not physically impeded from being separated from one another, the weight ratio of said polyacrylonitrile component to said polyolefin component ranges from about 80/20 to about 20/80, and the fiber is a segmented ribbon fiber having a rectangular cross-sectional configuration and comprises a plurality of polymer segments formed of a melt-processable polyacrylonitrile polymer alternating with a plurality of polymer segments formed of a polyolefin polymer.

12. A mechanically splittable multicomponent fiber having an outer peripheral surface comprising:

at least one polymer component comprising a melt processable polyacrylonitrile polymer; and at least one polymer component comprising a polyolefin, wherein each of said polymer components forms a portion of the outer peripheral surface of said fiber to form distinct unocclusive cross-sectional segments along a length of the fiber so that said components are not physically impeded from being separated from one another, the weight ratio of said polyacrylonitrile component to said polyolefin component ranges from about 80/20 to about 20/80, and the fiber is a segmented multilobal fiber.

13. The fiber of claim 12, wherein said segmented multilobal fiber has a cross shaped cross-sectional configuration comprising four arms extending from a common core, each of said arms comprising one or more one polymer segments formed of a melt-processable polyacrylonitrile polymer alternating with one or more polymer segments formed of a polyolefin polymer.

14. The fiber of claim 12, wherein said segmented multilobal fiber comprises at least three arms extending outwardly from a central region of said fiber, wherein said central region of said fiber comprises one of said polyacrylonitrile polymer or said polyolefin polymer and each of said arms comprises a tip region adjacent said common core and comprising the other of said polyacrylonitrile polymer or polyolefin polymer.

15. The fiber of claim 10, wherein said melt processable polyacrylonitrile polymer is selected from the group consisting of modacrylic and acrylic polymers.

16. The fiber of claim 15, wherein said melt processable polyacrylonitrile polymer comprises at least about 85% by weight acrylonitrile units.

17. The fiber of claim 10, wherein said polyolefin is selected from the group consisting of polyethylene, polypropylene, poly-1-butene, and copolymers, terpolymers, and mixtures thereof.

18. The fiber of claim 17, wherein said polyolefin is polypropylene.

19. The fiber of claim 10, wherein said melt processable polyacrylonitrile polymer comprises at least about 85% by weight acrylonitrile units and said polyolefin is polypropylene.

20. The fiber of claim 10, wherein said fiber is selected from the group consisting of continuous filaments, staple fibers, and meltblown fibers.

21. The fiber of claim 20, wherein said fiber is a staple fiber.

22. The fiber of claim 10, wherein said multicomponent fiber is capable of being dissociated by hydroentangling or needle punching.

23. The fiber of claim 11, wherein said melt processable polyacrylonitrile polymer is selected from the group consisting of modacrylic and acrylic polymers.

24. The fiber of claim 23, wherein said melt processable polyacrylonitrile polymer comprises at least about 85% by weight acrylonitrile units.

25. The fiber of claim 11, wherein said polyolefin is selected from the group consisting of polyethylene, polypropylene, poly-1-butene, and copolymers, terpolymers, and mixtures thereof.

26. The fiber of claim 25, wherein said polyolefin is polypropylene.

27. The fiber of claim 11, wherein said melt processable polyacrylonitrile polymer comprises at least about 85% by weight acrylonitrile units and said polyolefin is polypropylene.

28. The fiber of claim 11, wherein said fiber is selected from the group consisting of continuous filaments, staple fibers, and meltblown fibers.

29. The fiber of claim 24, wherein said fiber is a staple fiber.

30. The fiber of claim 11, wherein said multicomponent fiber is capable of being dissociated by hydroentangling or needle punching.

31. The fiber of claim 12, wherein said melt processable polyacrylonitrile polymer is selected from the group consisting of modacrylic and acrylic polymers.

32. The fiber of claim 31, wherein said melt processable polyacrylonitrile polymer comprises at least about 85% by weight acrylonitrile units.

33. The fiber of claim 12, wherein said polyolefin is selected from the group consisting of polyethylene, polypropylene, poly-1-butene, and copolymers, terpolymers, and mixtures thereof.

34. The fiber of claim 33, wherein said polyolefin is polypropylene.

35. The fiber of claim 12, wherein said melt processable polyacrylonitrile polymer comprises at least about 85% by weight acrylonitrile units and said polyolefin is polypropylene.

36. The fiber of claim 12, wherein said fiber is selected from the group consisting of continuous filaments, staple fibers, and meltblown fibers.

37. The fiber of claim 36, wherein said fiber is a staple fiber.

38. The fiber of claim 12, wherein said multicomponent fiber is capable of being dissociated by hydroentangling or needle punching.

* * * * *

UNITED STATES PATENT AND TRADEMARK OFFICE

CERTIFICATE OF CORRECTION

PATENT NO. : 6,444,312 B1
DATED : September 3, 2002
INVENTOR(S) : Dugan

It is certified that error appears in the above-identified patent and that said Letters Patent is hereby corrected as shown below:

Title page,
Item [75], Inventor, in the address, "Johnson City" should read -- Erwin --.
Item [73], Assignee, in the address, "Johnston City" should read -- Johnson City --.
Item [56], References Cited, U.S. PATENT DOCUMENTS, "Helm" should read -- Helms --.

Column 15,
Line 45, after "comprising" the semicolon ";" should be a colon -- : --.

Column 18,
Line 12, "claim 24" should read -- claim 28 --.

Signed and Sealed this

Twenty-ninth Day of April, 2003

JAMES E. ROGAN
*Director of the United States Patent and Trademark Office*